US008754916B2

(12) United States Patent
Lv et al.

(10) Patent No.: US 8,754,916 B2
(45) Date of Patent: Jun. 17, 2014

(54) LABEL PRINTER

(75) Inventors: Gaoren Lv, Guangdong (CN); Yueqin Zheng, Shenzhen (CN); Senbing Zhao, Shenzhen (CN); Haiyun Deng, Shenzhen (CN); Rong Xie, Shenzhen (CN); Liang Chen, Shenzhen (CN)

(73) Assignee: Postek Electronics Co., Ltd, Shenzhen (CN)

( * ) Notice: Subject to any disclaimer, the term of this patent is extended or adjusted under 35 U.S.C. 154(b) by 0 days.

(21) Appl. No.: 13/811,658

(22) PCT Filed: Jul. 22, 2010

(86) PCT No.: PCT/CN2010/075394

§ 371 (c)(1),
(2), (4) Date: Jan. 22, 2013

(87) PCT Pub. No.: WO2012/009857

PCT Pub. Date: Jan. 26, 2012

(65) Prior Publication Data

US 2013/0229475 A1 Sep. 5, 2013

(51) Int. Cl.
*B41J 15/04* (2006.01)
*B41J 3/407* (2006.01)

(52) U.S. Cl.
CPC ..... *B41J 15/042* (2013.01); *B41J 3/4075* (2013.01)
USPC ..... 347/197; 347/222

(58) Field of Classification Search
CPC ..... B41J 15/042; B41J 3/4075
USPC ..... 347/197, 222; 400/120.16
See application file for complete search history.

(56) References Cited

U.S. PATENT DOCUMENTS

| | | | | | |
|---|---|---|---|---|---|
| 4,562,444 | A | * | 12/1985 | Nagashima et al. | 347/215 |
| 4,614,949 | A | * | 9/1986 | Hakkaku et al. | 347/216 |
| 4,641,980 | A | * | 2/1987 | Matsumoto et al. | 400/693 |
| 5,150,130 | A | * | 9/1992 | Sato | 347/222 |
| 5,401,352 | A | * | 3/1995 | Matsushita et al. | 156/384 |
| 6,053,648 | A | * | 4/2000 | Mistyurik | 400/693 |
| 6,232,996 | B1 | * | 5/2001 | Takahashi et al. | 347/222 |

* cited by examiner

*Primary Examiner* — Huan Tran

(57) ABSTRACT

A label printer is provided. The label printer comprises a stationary housing (100) and a side cover (200) which are rotationally connected; a mechanism set is fixed in the stationary housing; at least two fixed shafts are set between a first side plate (800) and a second side plate (801) of the printer module frame; a pinch plate (5) used to support the second side plate is rotationally installed at the side of the mechanism base; a printer set (10,2,1) between the first side plate and the second side plate. The label printer in the invention is convenient to change or assemble the consumable.

18 Claims, 11 Drawing Sheets

LABEL PRINTER

CROSS-REFERENCE TO RELATED APPLICATION

The present application is a 371 of international application No. PCT/CN2010/075394 filed on Jul. 22, 2010; the contents of which are hereby incorporated by reference.

FIELD OF THE INVENTION

The present invention relates to printers, more particularly, to a label printer.

BACKGROUND OF THE INVENTION

Currently, all the label printers in commercial model, desktop model or mini model that used in the market are in a structure of opening at the top, that is to say, the housing of the printers can be opened at the top. Thus, the consumable only can be put into the printers through the top of them. And it is hard to change scrolls as the space for media going through are too small if opens at the top. It is always necessary to add outside paper frames to accommodate large rolls of labels if multitudinous printing tasks are demanded in the practical work process. However, with the present printers whose covers can be flipped forward and backward, the label paper must pass through between the top cover and bottom housing, which is inconvenient to operate.

And the fixing manner of the printhead module in traditional commercial, desktop or mini label printer always demands a support point on each side of the paper outlet to fix, ensuring the stress balance of both sides of the printhead module so as to perform a consistent printing effect on a whole piece of paper.

However, it is hard to operate when assembling the consumable as the side support points and the printer head module of the commercial, desktop or mini label printer in the prior art are always closed, resulting in that the consumable can only be passed through the small close gap between the printhead module and the rubber roller and the mechanism module. And it is inconvenient to operate as the consumable must be cut off to pass through the small passage when changing the consumable.

In a word, it is hard to operate when changing scrolls due to the limited space for paper passing through in traditional desktop printer, and it is very likely to damage the desktop printer and shorten the product life if mis-operated when changing the scrolls.

SUMMARY OF THE INVENTION

The objective of the present invention is to provide a label printer and a method for using it, aiming at the disadvantage of hard operating when assembling the consumable as the commercial-model, desktop or mini label printer in the prior art is opened at its top while the side support points and the printer head module are always closed.

The technical solution of the present invention for solving the problem is to provide a label printer which comprises a stationary housing and a side cover which are rotationally connected; a top and at least one side of the stationary housing are opened, and the side cover covers an opening of the stationary housing; a mechanism module is fixed in the stationary housing, and the mechanism module comprises a mechanism base fixed on a bottom of the stationary housing and a printer module frame fixed on the mechanism base; at least two fixed shafts are set between a first side plate and a second side plate of the printer module frame, and the second side plate is located at an opening of sides of the mechanism base and the printer module frame, and a gap occurs between the second side plate and the mechanism base; a left ribbon support module is rotationally installed on the mechanism module, a right ribbon support module is rotationally installed on the printer module frame, and a ribbon can be provided between the left ribbon support module and the right ribbon support module; a printer set between the first side plate and the second side plate is rotationally installed on the printer module frame, a passage for passing through consumable is set between the mechanism base and the printer set, and a pinch plate used to support the second side plate is rotationally installed at a side of the mechanism base, a side of the passage is opened when the pinch plate is horizontal to detach from the second side plate; a force application set used to adjust a position of the printer set and provide stress to the printer set is rotationally installed between the first side plate and the second side plate, and the force application set is contacted with the printer set, the printer set comprises a tortuous spring member provided on one end thereof.

In the label printer of the present invention, the printer set comprises a carrier rotational axis rotationally installed between the first side plate and the second side plate, a printer head carrier and a printer head fixed on the printer head carrier, the printer head carrier is fixed on the carrier rotational axis, and a spring member is provided on one end of the carrier rotational axis, wherein the spring member is a twisted spring whose ends are fixed respectively and in a tortuous state.

In the label printer of the present invention, the force application set comprises a rotational axis rotationally installed between the first side plate and the second side plate, and a force application member is fixed on the rotational axis and contacted with the printer head carrier, and one end of the rotational axis is provided with a handle outside of the second side plate.

In the label printer of the present invention, a paper outlet at one side of the mechanism module can be formed when the side cover and the stationary housing are closed up, wherein the rubber roller of the mechanism module is parallel to a plane of the paper outlet.

In the label printer of the present invention, an inside paper frame is set on an other side of the mechanism module, and a removable axis that is parallel to the rubber roller is fixed on the inside paper frame, and a consumable is rotationally set on the axis; print paper of the consumable stretches out from the paper outlet through the passage of the mechanism module.

In the label printer of the present invention, an outside paper frame is provided outside the label printer, and an axis which is unrotatable but extractable freely is set on the outside paper frame and a consumable is rotationally set on the axis; wherein, the axis is parallel to the rubber roller, print paper of the consumable stretches out from the paper outlet through the passage of the mechanism module.

In the label printer of the present invention, the handle is located at a first position, the force application member presses down the printer head carrier, the twisted spring is in a tortuous state, and the pinch plate fastens and supports the second side plate, the handle fastens the pinch plate.

In the label printer of the present invention, the handle is located at a second position, the pinch plate is horizontal, the printer head is driven away from the rubber roller and the mechanism base by the printer head carrier through a twisting force of the twisted spring, and a side of the passage for the consumable between the printer head and the rubber roller and the mechanism base is opened.

When implementing the label printer of the present invention, the following advantageous effects can be achieved.

1) It is convenient to change or assemble the consumable with the label printer of the present invention, the right side of the passage between the printer head module and the rubber roller and the mechanism module is opened after opening the pinch plate of the printer head module, and the consumable can be passed or removed through the passage without being cut off.

2) It is more convenient for users to change or assemble the consumable as the label printer of the present invention is opened at its sides which enlarge the space for user to change or assemble to consumable, avoiding damaging the desktop printer by mis-operation when changing the scroll resulting from the small space for passing the paper.

3) The label printer of the present invention is in a compact structure to occupy small space.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

Figure 1:
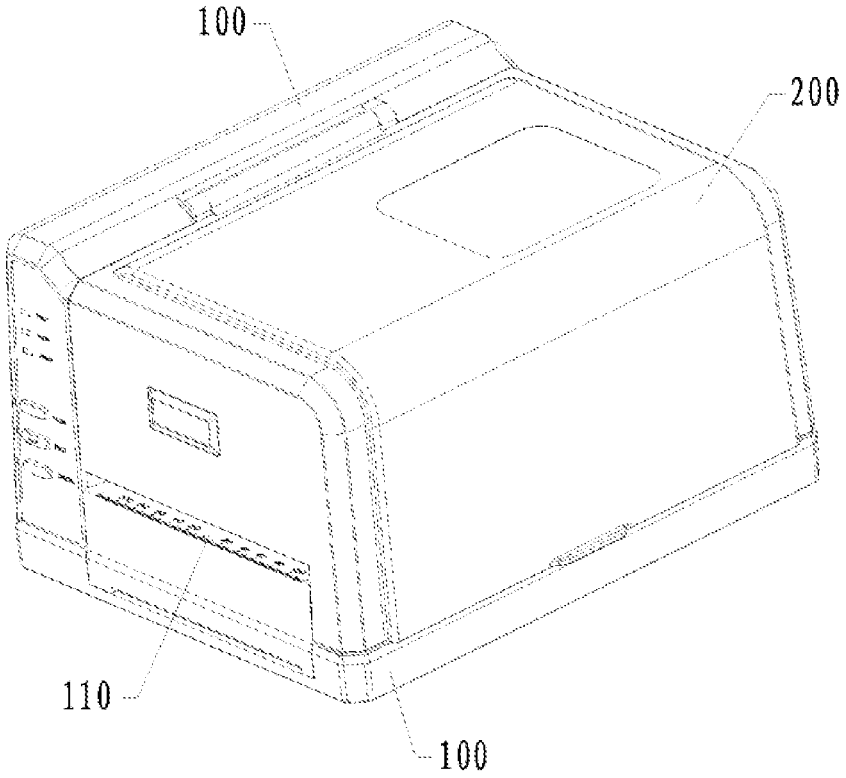
FIG. 1 is an assembling structural diagram of a desktop printer in a specific embodiment of the present invention.

Referring to FIG. 1, in a specific embodiment of a label printer in the present invention, the label printer comprises a stationary housing 100 and a side cover 200 which are rotationally connected. The top and at least one side of the stationary housing 100 are opened, and the side cover 200 covers the opening of the stationary housing 100. A paper outlet 110 can be formed when the side cover 200 and the stationary housing 100 are closed up.

Figure 2:
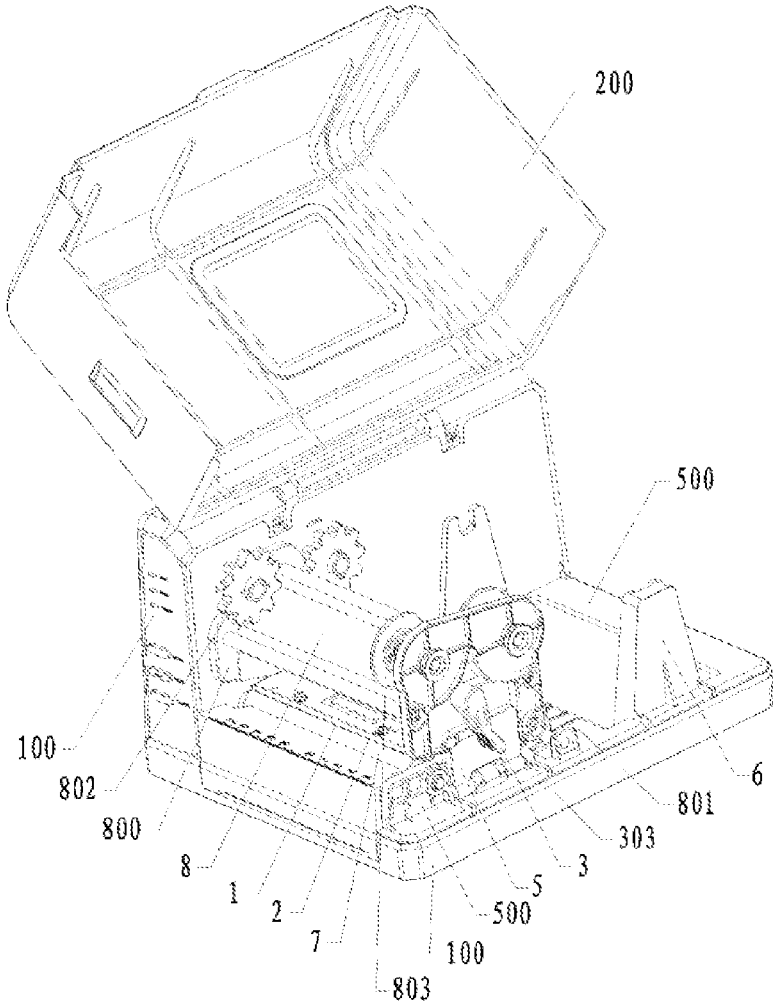
FIG. 2 is an inside structural diagram of the desktop printer in the specific embodiment of the present invention.

Referring to FIG. 2, a mechanism module is fixed in the stationary housing 100, and the paper outlet 110 is located at one side of the mechanism module while the rubber roller 7 of the mechanism module is parallel to the plane of the paper outlet 110. The mechanism module comprises a mechanism base 500 fixed on the bottom of the stationary housing 100 and a printer module frame 8 fixed on the mechanism base 500. At least two fixed shafts are set between a first side plate 800 and a second side plate 801 of the printer module frame 8, and the second side plate 801 is located at the opening of the sides of the mechanism base 500 and the printer module frame 8, and a gap occurs between the second side plate 801 and the mechanism base 500.

Figure 12:
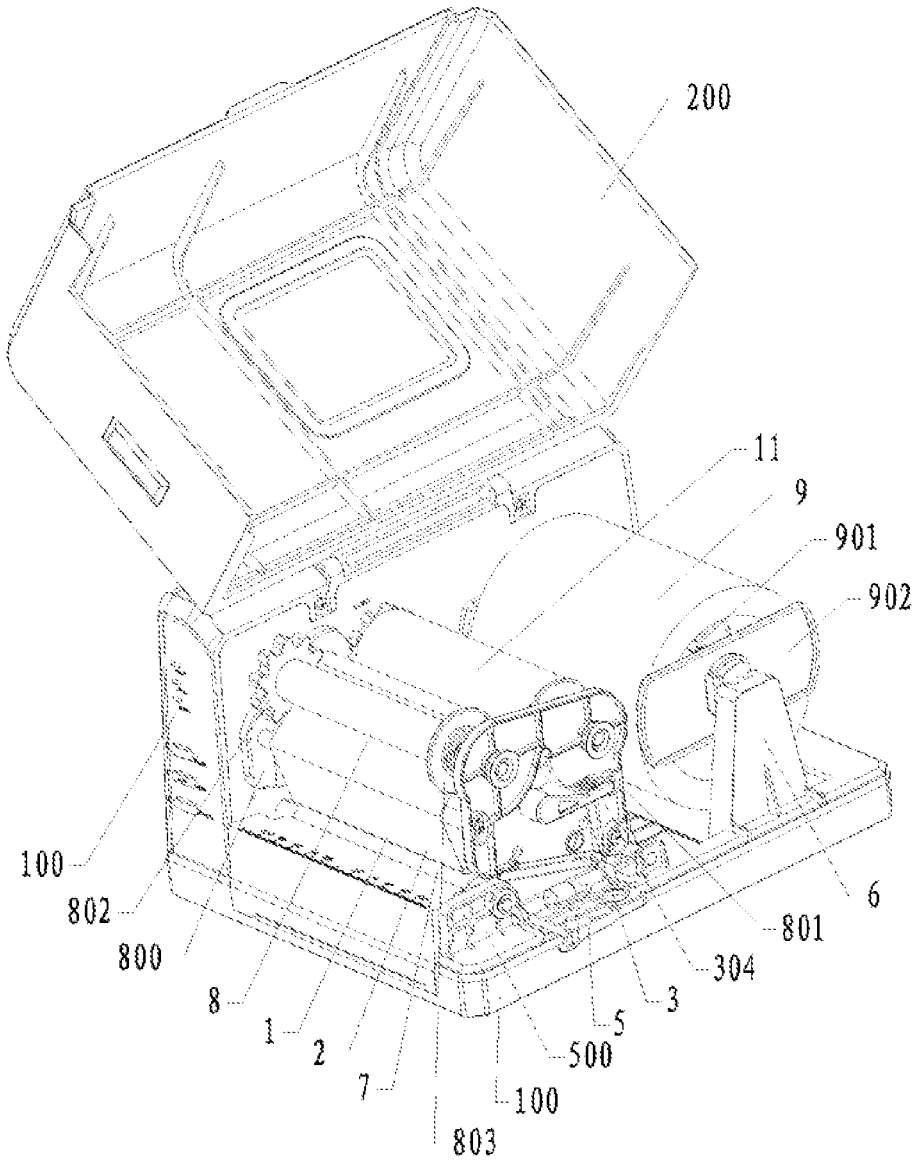
FIG. 12 is a structural diagram of a first method for using the label printer of the present invention when the handle is located at the second position.
Figure 13:
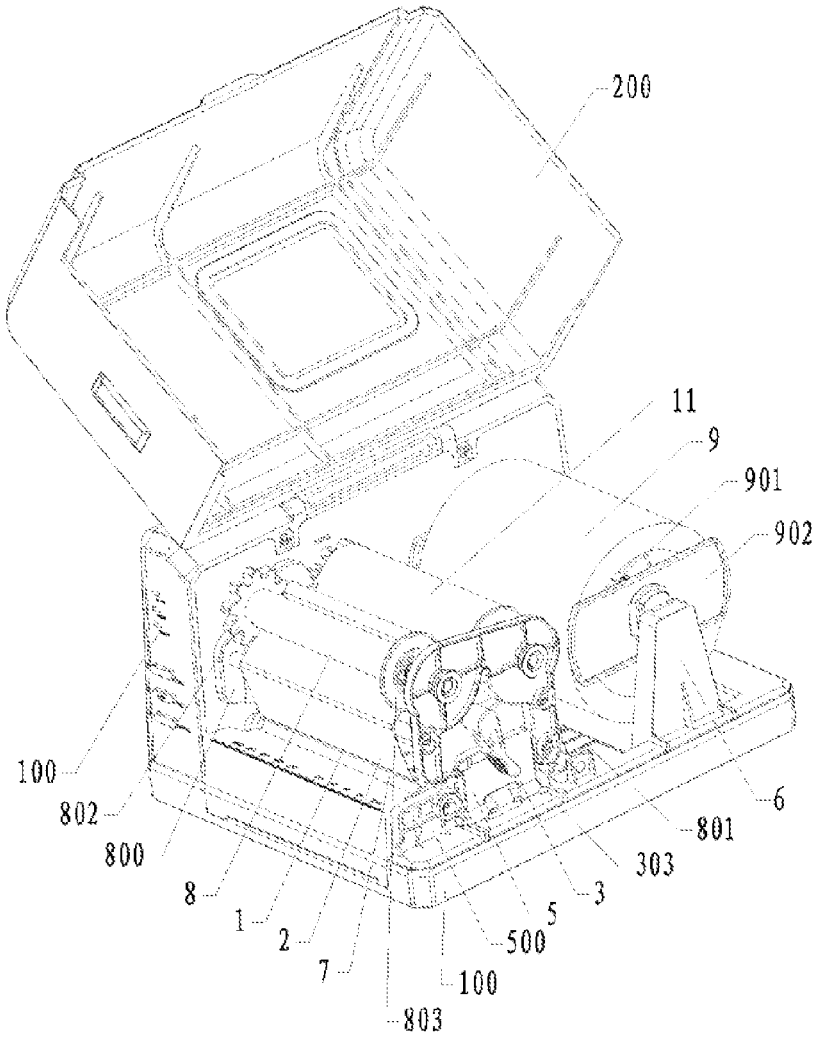
FIG. 13 is a structural diagram of a first method for using the label printer of the present invention when the handle is located at the first position.

Referring to FIGS. 12 and 13, a left ribbon support module 802 is rotationally installed on the mechanism module, a right ribbon support module 803 is rotationally installed on the printer module frame 8, and a ribbon 11 can be provided between the left ribbon support module 802 and the right ribbon support module 803.

Referring to FIG. 2, a printer set between the first side plate 800 and the second side plate 801 is rotationally installed on the printer module frame 8, a passage 900 for passing through the consumable is set between the mechanism base 500 and the printer set, and a pinch plate 5 used to support the second side plate 801 is rotationally installed at the side of the mechanism base 500. The side of the passage 900 is opened when the pinch plate 5 has been rotated to a horizontal position to detach from the second side plate 801.

A force application set used to adjust the position of the printer set and provide stress to the printer set is rotationally installed between the first side plate 800 and the second side plate 801, and contacted with the printer set. The printer set comprises a tortuous spring member provided on one end, and the printer set can be opened by the spring member through its twisting force after the stress of the force application set has been released.

Referring to FIGS. 2, 3, 4 and 6, the printer set comprises a carrier rotational axis 10 rotationally installed between the first side plate 800 and the second side plate 801, a printer head carrier 2 and a printer head 1 fixed on the printer head carrier. The printer head carrier 2 is fixed on the carrier rotational axis 10, and a spring member is provided on one end of the carrier rotational axis 10. In the embodiment, the spring member is a twisted spring 4 whose both ends are fixed respectively and stays in a tortuous state.

Figure 3:
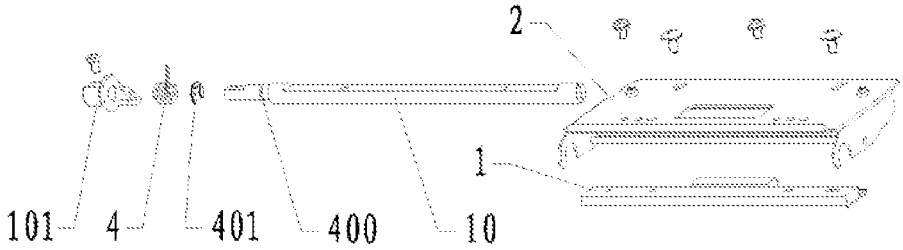
FIG. 3 is an exploding diagram of a printer set in the specific embodiment of the present invention.
Figure 4:
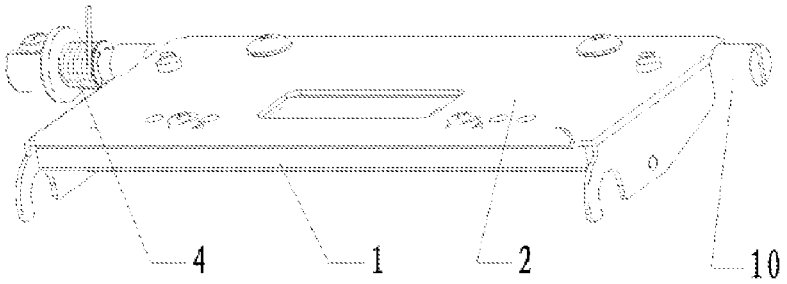
FIG. 4 is an assembling diagram of the printer set in the specific embodiment of the present invention.
Figure 9:
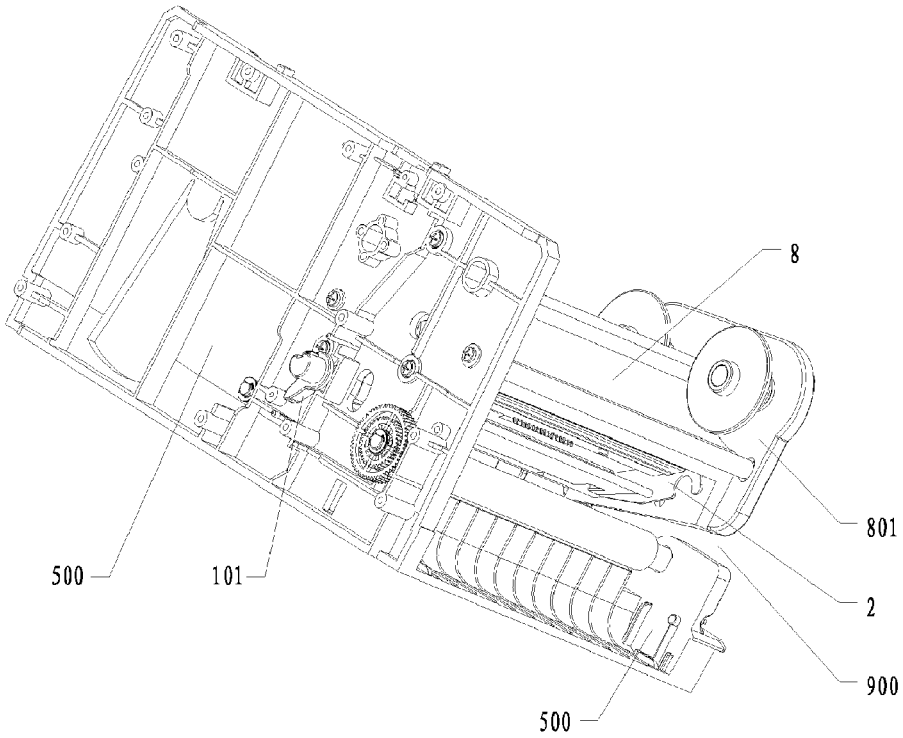
FIG. 9 is a structural diagram of the mechanism module of the label printer in the specific embodiment of the present invention when the handle is located at the second position.
Figure 10:
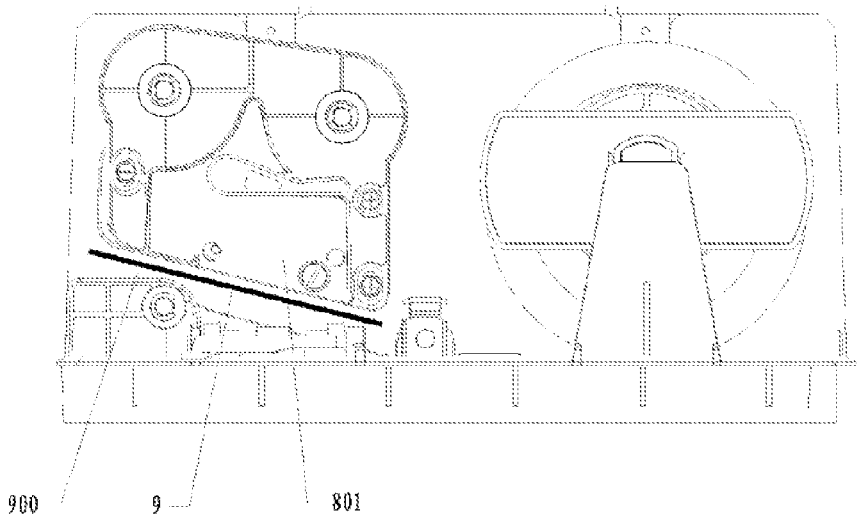
FIG. 10 is a front view of the printer module of the label printer in the specific embodiment of the present invention when the handle is located at the second position.

Referring to FIGS. 3 and 4, clamp spring assembling slot 400 is set on one end of the carrier rotational axis 10, and a clamp spring 401 is assembled in the clamp spring assembling slot 400. A twisted spring 4 is provided outside the clamp spring 401, and a fix member 101 is fixed on the end of the carrier rotational axis 10 outside of the twisted spring 4. The clamp spring 401 and the fix member 101 are used to locate the twisted spring 4 respectively. Referring to FIG. 9, both ends of the twisted spring 4, namely both ends of the metal wire that is twisted into the twisted spring 4, are located through the fix member 101 and the first side plate 800 respectively.

Figure 5:
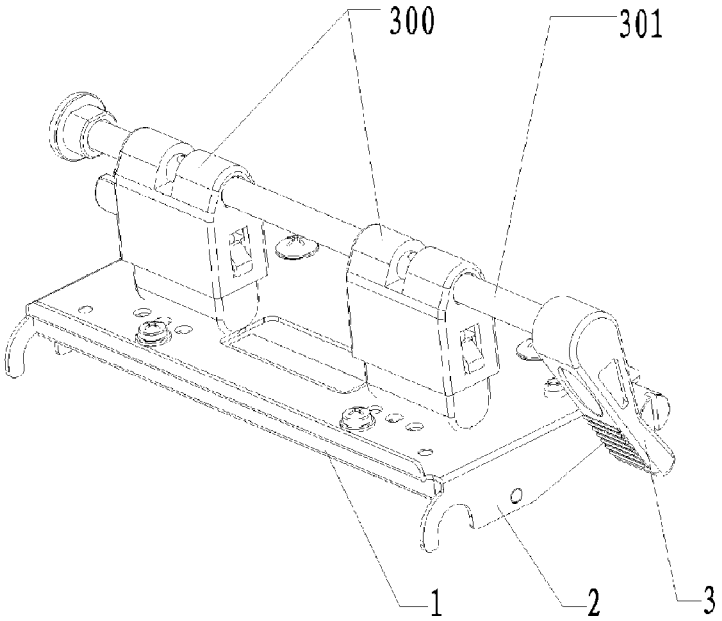
FIG. 5 is an assembling diagram of the printer set and the force application set of the desktop printer in the specific embodiment of the present invention when the handle is located at a first position.
Figure 6:
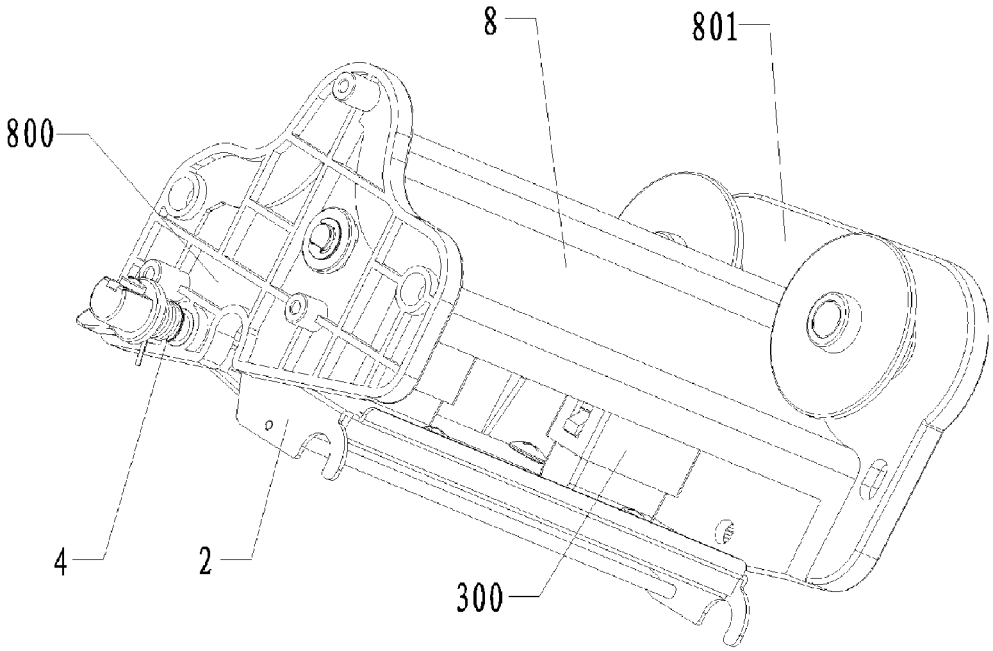
FIG. 6 is a structural diagram in part of the printer set and the force application set of the desktop printer in the specific embodiment of the present invention assembled in the printer.
Figure 7:
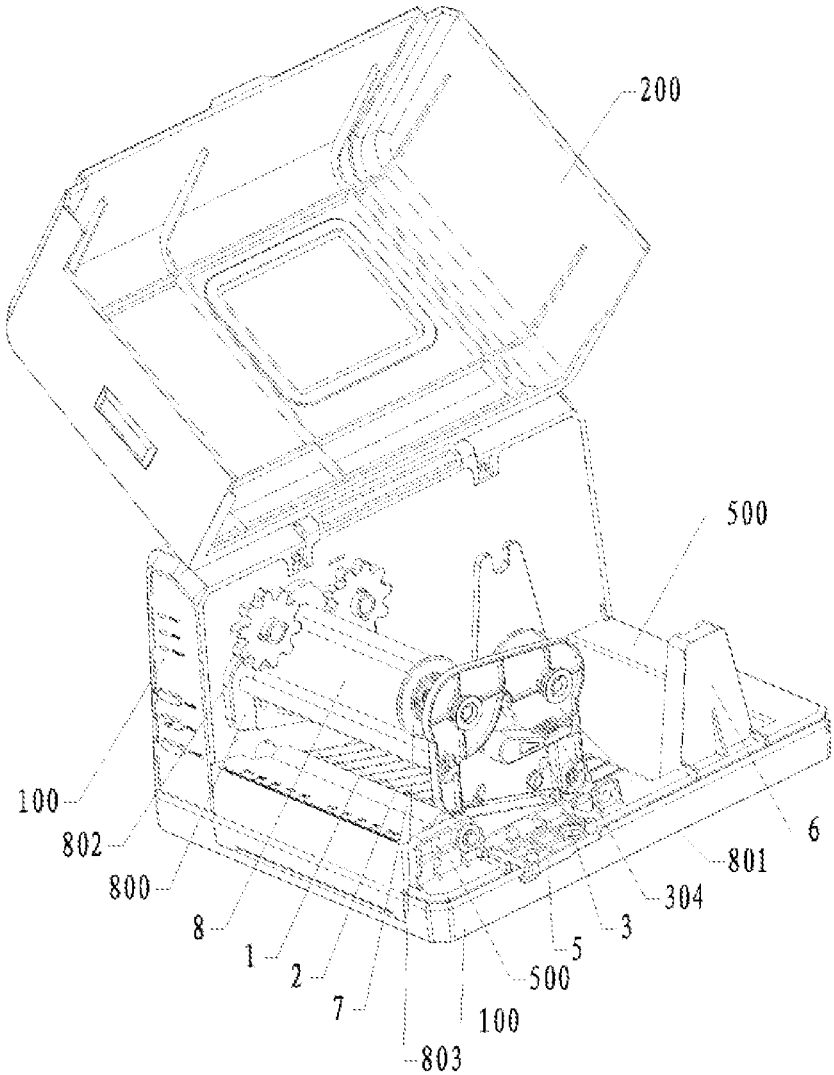
FIG. 7 is an inside structural diagram of the desktop printer in the specific embodiment of the present invention when the handle is located at a second position.
Figure 8:
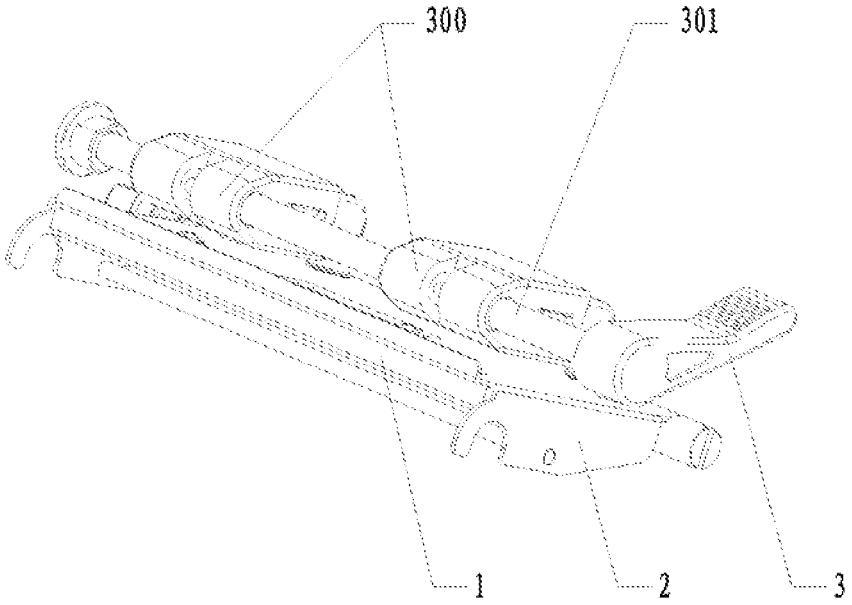
FIG. 8 is an assembling diagram of the printer set and the force application set of the label printer in the specific embodiment of the present invention when the handle is located at the second position.

Referring to FIGS. 2, 5 and 6, the force application set comprises a rotational axis 301 rotationally installed between the first side plate 800 and the second side plate 801, and a force application member 300 is fixed on the rotational axis 301. The force application member 300 is contacted with the printer head carrier 2, and one end of the rotational axis 301 is provided with a handle 3 outside of the second side plate 801.

Referring to FIGS. 1, 11, 12 and 13, an inside paper frame 6 is set on the other side of the mechanism module, and a removable axis 901 that is parallel to the rubber roller 7 is fixed on the inside paper frame 6, and a consumable 9 is rotationally set on the axis 901. Print paper of the consumable 9 stretches out from the paper outlet 110 through the passage 900 of the mechanism module.

Figure 11:
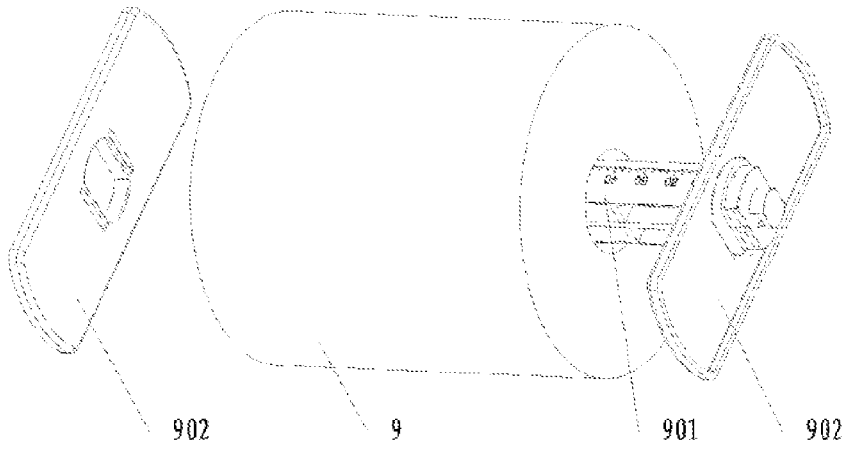
FIG. 11 is a decomposing diagram of assembling the consumable in the desktop printer in the specific embodiment of the present invention.
Figure 14:
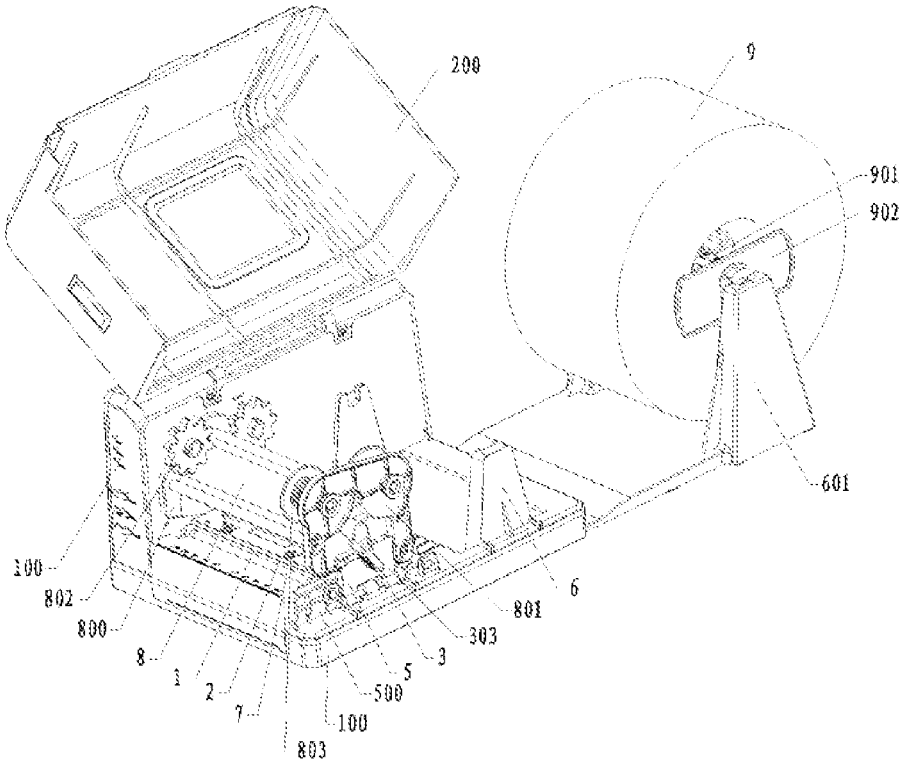
FIG. 14 is a structural diagram of a second method for using the label printer of the present invention.

Referring to FIGS. 1, 11 and 14, an outside paper frame 601 is provided outside the label printer, and a removable axis 901 that is parallel to the rubber roller 7 is fixed on the outside paper frame 601, and a consumable 9 is rotationally set on the axis. Print paper of the consumable 9 stretches out from the paper outlet 110 through the passage 900 of the mechanism module.

Both ends of the axis 901 and both sides of the consumable 9 are provided with a consumable limit plate 902 respectively, wherein at least one consumable limit plate 902 is removably fixed on one end of the axis 901. The length and/or width of the consumable limit plate 902 are larger than the internal diameter of the consumable 9 respectively.

Referring to FIGS. 2, 5 and 6, the handle 3 is located at a first position 303, the force application member 300 presses down the printer head carrier 2, and the twisted spring 4 is in a tortuous state. The pinch plate 5 fastens and supports the second side plate 801, and the handle 3 fastens the pinch plate 5.

Referring to FIGS. 7, 8 9 and 10, the handle 3 is located at a second position 304, and the pinch plate 5 is horizontal. The printer head 1 is driven away from the rubber roller 7 and the mechanism base 500 by the printer head carrier 2 through the twisting force of the twisted spring 4, and the right side of the passage 900 for the consumable between the printer head 1 and the rubber roller 7 and the mechanism base 500 is opened.

The operating steps are as follows when assembling the consumable 9 into the label printer.

S1: Open the side cover 200 and turn the handle 3 to the second position 304 to release the stress to the printer head carrier 2 provided by the force application member 300. The printer head carrier 2 is reversed upward by the twisting force of the twisted spring 4 to drive the printer head 1 away from the rubber roller 7 and the mechanism base 500, and thus a passage 900 is formed between the printer head 1 and the mechanism base 500, and then the pinch plate 5 is turned to a horizontal position to open the right side of the passage 900.

S2: Remove the axis 901 on the inside paper frame 6 or outside paper frame 601, and remove the consumable baffle on one end of the axis 901 and then assemble the consumable 9 on the axis 901. Further assemble the removed consumable baffle and then assemble the axis 901 equipped with the consumable 9 on the inside paper frame 6 or the outside paper frame 60. Finally assemble the consumable 9 through the gap between the second side plate 801 and the mechanism base 500 into the passage 900 and stretch it out from the paper outlet 110.

The operating steps are as follows when changing the consumable 9 in the label printer.

S1: Open the side cover 200 and turn the handle 3 to the second position 304 to release the stress to the printer head carrier 2 provided by the force application member 300. The printer head carrier 2 is reversed upward through the twisting force of the twisted spring 4 to drive the printer head 1 away from the rubber roller 7 and the mechanism base 500, and thus a passage 900 is formed between the printer head 1 and the mechanism base 500, and then the pinch plate 5 is turned to a horizontal position to open the right side of the passage 900.

S2: Remove the remaining consumable from the passage 900. Then remove the axis 901 on the inside paper frame 6 or outside paper frame 601, and remove the consumable baffle on one end of the axis 901 to remove the remaining consumable.

S3: Assemble new consumable 9 on the axis 901, and assemble the removed consumable baffle and then assemble the axis 901 equipped with new consumable 9 on the inside paper frame 6 or the outside paper frame 601. Finally assemble the consumable 9 through the gap between the second side plate 801 and the mechanism base 500 into the passage 900 and stretch it out from the paper outlet 110.

There are two methods for using the label printer stated above.

The first method referring to FIGS. 12 and 13 comprises steps of assembling a ribbon 11 on the printer module, fastening and supporting the second side plate 801 through the pinch plate 5 and returning the handle 3 to the first position 303 to fasten the pinch plate 5 after having assembled or changed new consumable 9 on the inside paper frame 6 in accordance with the method stated above. Then closing the side cover 200 and connecting the power, and the label printer can start to work.

The second method referring to FIG. 14 comprises steps of assembling an outside paper frame 601 outside the label printer, fastening and supporting the second side plate 801 through the pinch plate 5 and returning the handle 3 to the first position 303 to fasten the pinch plate 5 after having assembled or changed new consumable 9 on the inside paper frame 6 in accordance with the method stated above, then assembling a ribbon 11 on the printer module, closing the side cover 200 and connecting the power, and the label printer can start to work.

While the embodiments of the present invention are described with reference to the accompanying drawings above, the present invention is not limited to the above-mentioned specific implementations. In fact, the above-mentioned specific implementations are intended to be exemplary not to be limiting. In the inspiration of the present invention, those ordinary skills in the art can also make many modifications without breaking away from the subject of the present invention and the protection scope of the claims. All these modifications belong to the protection of the present invention.

The invention claimed is:

1. A label printer, comprising a stationary housing (100) and a side cover (200) which are rotationally connected; wherein a top and at least one side of the stationary housing (100) are opened, and the side cover (200) covers an opening of the stationary housing (100); a mechanism module is fixed in the stationary housing (100), and the mechanism module comprises a mechanism base (500) fixed on a bottom of the stationary housing (100) and a printer module frame (8) fixed on the mechanism base (500); at least two fixed shafts are set between a first side plate (800) and a second side plate (801) of the printer module frame (8), and the second side plate (801) is located at an opening of sides of the mechanism base (500) and the printer module frame (8), and a gap occurs between the second side plate (801) and the mechanism base (500); a left ribbon support module (802) is rotationally installed on the mechanism module, a right ribbon support module (803) is rotationally installed on the printer module frame (8), and a ribbon (11) can be provided between the left ribbon support module (802) and the right ribbon support module (803); a printer set between the first side plate (800)

and the second side plate (801) is rotationally installed on the printer module frame (8), a passage for passing through the consumable is set between the mechanism base (500) and the printer set, and a pinch plate (5) used to support the second side plate (801) is rotationally installed at a side of the mechanism base (500), a side of the passage is opened when the pinch plate (5) is horizontal to detach from the second side plate (801); a force application set used to adjust a position of the printer set and provide stress to the printer set is rotationally installed between the first side plate (800) and the second side plate (801), and the force application set is contacted with the printer set which comprises a tortuous spring member provided on one end.

2. The label printer according to claim 1, wherein, the printer set comprises a carrier rotational axis (10) rotationally installed between the first side plate (800) and the second side plate (801), a printer head carrier (2) and a printer head (1) fixed on the printer head carrier (2), the printer head carrier (2) is fixed on the carrier rotational axis (10), and a spring member is provided on one end of the carrier rotational axis (10), wherein the spring member is a twisted spring (4) whose ends are fixed respectively and in a tortuous state.

3. The label printer according to claim 2, wherein, the force application set comprises a rotational axis (301) rotationally installed between the first side plate (800) and the second side plate (801), and a force application member (300) is fixed on the rotational axis (301), the force application member (300) is contacted with the printer head carrier (2), and one end of the rotational axis (301) is provided with a handle (3) outside of the second side plate (801).

4. The label printer according to claim 3, wherein, the handle (3) is located at a first position, the force application member (301) presses down the printer head carrier (2), the twisted spring (4) is in a tortuous state, and the pinch plate (5) fastens and supports the second side plate (801), the handle (3) fastens the pinch plate (5).

5. The label printer according to claim 2, wherein, the handle (3) is located at a first position, the force application member (301) presses down the printer head carrier (2), the twisted spring (4) is in a tortuous state, and the pinch plate (5) fastens and supports the second side plate (801), the handle (3) fastens the pinch plate (5).

6. The label printer according to claim 2, wherein, the handle (3) is located at a second position, the pinch plate (5) is horizontal, the printer head (1) is driven away from the rubber roller (7) and the mechanism base (500) by the printer head carrier (2) through a twisting force of the twisted spring (4), and the side of the passage (900) for the consumable between the printer head (1) and the rubber roller (7) and the mechanism base (500) is opened.

7. The label printer according to claim 3, wherein, the handle (3) is located at a second position, the pinch plate (5) is horizontal, the printer head (1) is driven away from the rubber roller (7) and the mechanism base (500) by the printer head carrier (2) through a twisting force of the twisted spring (4), and the side of the passage (900) for the consumable between the printer head (1) and the rubber roller (7) and the mechanism base (500) is opened.

8. The label printer according to claim 1, wherein, a paper outlet (110) at one side of the mechanism module can be formed when the side cover (200) and the stationary housing (100) are closed up, wherein the rubber roller (7) of the mechanism module is parallel to a plane of the paper outlet (110).

9. The label printer according to claim 8, wherein, an inside paper frame (6) is set on an other side of the mechanism module, and a removable axis that is parallel to the rubber roller (7) is fixed on the inside paper frame (6), and a consumable (9) is rotationally set on the axis; print paper of the consumable (9) stretches out from the paper outlet (110) through the passage of the mechanism module.

10. The label printer according to claim 9, wherein, the handle (3) is located at a first position, the force application member (301) presses down the printer head carrier (2), the twisted spring (4) is in a tortuous state, and the pinch plate (5) fastens and supports the second side plate (801), the handle (3) fastens the pinch plate (5).

11. The label printer according to claim 9, wherein, the handle (3) is located at a second position, the pinch plate (5) is horizontal, the printer head (1) is driven away from the rubber roller (7) and the mechanism base (500) by the printer head carrier (2) through a twisting force of the twisted spring (4), and the side of the passage (900) for the consumable between the printer head (1) and the rubber roller (7) and the mechanism base (500) is opened.

12. The label printer according to claim 8, wherein, an outside paper frame (601) is provided outside the label printer, and a removable axis (901) that is parallel to the rubber roller (7) is fixed on the outside paper frame (601), and a consumable (9) is rotationally set on the axis (901); the consumable (9) stretches out from the paper outlet (110) through the passage (900) of the mechanism module.

13. The label printer according to claim 12, wherein, the handle (3) is located at a first position, the force application member (301) presses down the printer head carrier (2), the twisted spring (4) is in a tortuous state, and the pinch plate (5) fastens and supports the second side plate (801), the handle (3) fastens the pinch plate (5).

14. The label printer according to claim 12, wherein, the handle (3) is located at a second position, the pinch plate (5) is horizontal, the printer head (1) is driven away from the rubber roller (7) and the mechanism base (500) by the printer head carrier (2) through a twisting force of the twisted spring (4), and the side of the passage (900) for the consumable between the printer head (1) and the rubber roller (7) and the mechanism base (500) is opened.

15. The label printer according to claim 8, wherein, the handle (3) is located at a first position, the force application member (301) presses down the printer head carrier (2), the twisted spring (4) is in a tortuous state, and the pinch plate (5) fastens and supports the second side plate (801), the handle (3) fastens the pinch plate (5).

16. The label printer according to claim 8, wherein, the handle (3) is located at a second position, the pinch plate (5) is horizontal, the printer head (1) is driven away from the rubber roller (7) and the mechanism base (500) by the printer head carrier (2) through a twisting force of the twisted spring (4), and the side of the passage (900) for the consumable between the printer head (1) and the rubber roller (7) and the mechanism base (500) is opened.

17. The label printer according to claim 1, wherein, the handle (3) is located at a first position, the force application member (301) presses down the printer head carrier (2), the twisted spring (4) is in a tortuous state, and the pinch plate (5) fastens and supports the second side plate (801), the handle (3) fastens the pinch plate (5).

18. The label printer according to claim 1, wherein, the handle (3) is located at a second position, the pinch plate (5) is horizontal, the printer head (1) is driven away from the rubber roller (7) and the mechanism base (500) by the printer head carrier (2) through a twisting force of the twisted spring (4), and the side of the passage (900) for the consumable between the printer head (1) and the rubber roller (7) and the mechanism base (500) is opened.

* * * * *